US009489958B2

(12) United States Patent
Pilli et al.

(10) Patent No.: US 9,489,958 B2
(45) Date of Patent: Nov. 8, 2016

(54) SYSTEM AND METHOD TO REDUCE TRANSMISSION BANDWIDTH VIA IMPROVED DISCONTINUOUS TRANSMISSION

(71) Applicant: Nuance Communications, Inc., Burlington, MA (US)

(72) Inventors: Sridhar Pilli, Fremont, CA (US); Jose Lainez, London (GB); Dushyant Sharma, Marlow (GB); Daniel A. Barreda, London (GB); Patrick Naylor, London (GB); Mahesh Godavarti, Cupertino, CA (US)

(73) Assignee: Nuance Communications, Inc., Burlington, MA (US)

( * ) Notice: Subject to any disclaimer, the term of this patent is extended or adjusted under 35 U.S.C. 154(b) by 2 days.

(21) Appl. No.: 14/447,773

(22) Filed: Jul. 31, 2014

(65) Prior Publication Data

US 2016/0035359 A1 Feb. 4, 2016

(51) Int. Cl.

| | |
|---|---|
| ***G10L 25/78*** | (2013.01) |
| ***G10L 19/012*** | (2013.01) |
| *G10L 25/84* | (2013.01) |

(52) U.S. Cl.
CPC ..... *G10L 19/012* (2013.01); *G10L 25/84* (2013.01)

(58) Field of Classification Search
CPC ..... G10L 19/012
USPC ..... 704/1–10, 208–210, 214–215, 226, 504
See application file for complete search history.

(56) References Cited

U.S. PATENT DOCUMENTS

| | | | | |
|---|---|---|---|---|
| 2004/0030544 | A1* | 2/2004 | Ramabadran | G10L 25/78 704/205 |
| 2007/0192096 | A1* | 8/2007 | Metz | G10L 25/78 704/233 |
| 2009/0043577 | A1* | 2/2009 | Godavarti | G10L 21/02 704/233 |
| 2012/0120813 | A1* | 5/2012 | Johansson | G10L 19/22 370/249 |

* cited by examiner

*Primary Examiner* — Marcellus Augustin
(74) *Attorney, Agent, or Firm* — Holland & Knight LLP; Mark H. Whittenberger, Esq.

(57) ABSTRACT

The present disclosure is directed towards a method for discontinuous transmission ("DTX") bandwidth reduction. The method may include receiving, at a processor, a frame identified as speech and determining that the frame was mistakenly identified as speech based upon, at least in part, a voice activity detection algorithm. The method may further include labeling the frame as a silence indicator frame.

17 Claims, 6 Drawing Sheets

500

A's speech ----------> Encoder -----[EVP {Decoder-->VQA-->Encoder containing DBR}]----> Decoder ---> Received A's speech Received B's speech <------ Decoder <---- [{Encoder containing DBR<--VQA<--Decoder} EVP]----- Encoder <---- B's speech

FIG. 5

SYSTEM AND METHOD TO REDUCE TRANSMISSION BANDWIDTH VIA IMPROVED DISCONTINUOUS TRANSMISSION

TECHNICAL FIELD

This disclosure relates to communication networks and, more particularly, to systems and methods for reducing network transmission bandwidth in telecommunications networks.

BACKGROUND

In a typical phone conversation where both parties are not talking at the same time for most part, discontinuous transmission (DTX) saves the network bandwidth and power usage on handsets by transmitting information only when required. The standard adaptive multi-rate (AMR) speech codec does this by transmitting periodic encoded frames during speech (e.g., every 20 ms) but infrequent silence indicator (SID) frames during pauses/silence/noise (e.g., every 160 ms or greater). The receiver decodes the received speech and SID frames and injects comfort noise during the missing SID frames during DTX. The standard AMR speech encoder uses an inbuilt Voice Activity Detector (VAD) to determine the start and end of DTX transmission. However, this VAD is highly conservative and marks most real life noise as speech thereby losing the advantage of DTX for these types of real noises.

SUMMARY OF DISCLOSURE

In one implementation, a method for discontinuous transmission ("DTX") bandwidth reduction. The method may include receiving, at a processor, a frame identified as speech and determining that the frame was mistakenly identified as speech based upon, at least in part, a voice activity detection algorithm. The method may further include labeling the frame as a silence indicator frame.

One or more of the following features may be included. In some embodiments, the method may include bypassing an intended voice quality assurance processing operation based upon, at least in part, the determination. The method may also include computing a signal to noise ratio associated with the frame and adding a signal to noise ratio dependent holdover time prior to transmission. The method may further include computing a voice activity detection decision based upon, at least one of, channel power, voice metrics, and noise power parameters. In some embodiments, computing may occur every 10 ms. Computing may be based upon voice metrics, the voice metrics compared with a signal to noise ratio dependent threshold. In some embodiments, a starting VAD decision may always be active.

In another implementation, a system for discontinuous transmission ("DTX") bandwidth reduction is provided. The system may include a computing device configured to receive, at one or more processors, a frame identified as speech. The one or more processors may be further configured to determine that the frame was mistakenly identified as speech based upon, at least in part, a voice activity detection algorithm. The one or more processors may be further configured to label the frame as a silence indicator frame.

One or more of the following features may be included. In some embodiments, the one or more processors may be further configured to bypass an intended voice quality assurance processing operation based upon, at least in part, the determination. The one or more processors may be further configured to compute a signal to noise ratio associated with the frame. The one or more processors may be further configured to add a signal to noise ratio dependent holdover time prior to transmission. The one or more processors may be further configured to compute a voice activity detection decision based upon, at least one of, channel power, voice metrics, and noise power parameters. In some embodiments, computing may occur every 10 ms. Computing may be based upon voice metrics, the voice metrics compared with a signal to noise ratio dependent threshold. A starting VAD decision may always be active.

In another implementation, a method for discontinuous transmission ("DTX") bandwidth reduction is provided. The method may include receiving, at a processor, a frame identified as speech by an adaptive multi-rate ("AMR") encoder associated with a voice quality assurance module. The method may further include determining that the frame was mistakenly identified as speech by the AMR encoder based upon, at least in part, a voice activity detection algorithm. The method may include labeling the frame as a silence indicator frame and bypassing an intended voice quality assurance processing operation based upon, at least in part, the determination.

One or more of the following features may be included. In some embodiments, the method may include computing a signal to noise ratio associated with the frame and adding a signal to noise ratio dependent holdover time prior to transmission. The method may further include computing a voice activity detection decision based upon, at least one of, channel power, voice metrics, and noise power parameters.

The details of one or more implementations are set forth in the accompanying drawings and the description below. Other features and advantages will become apparent from the description, the drawings, and the claims.

BRIEF DESCRIPTION OF THE DRAWINGS

FIG. 5 is a diagrammatic view of an embodiment of a data path in accordance with an embodiment of the present disclosure.

Like reference symbols in the various drawings may indicate like elements.

DETAILED DESCRIPTION

Embodiments provided herein are directed towards an algorithm that may provide improved voice activity detection in a network based media processing entity to improve the DTX rate and thereby save transmission bandwidth. The improved voice activity detection in the network may provide a single network element that may improve the VAD decisions made by a variety of end points (e.g., handsets).

Accordingly, embodiments of bandwidth reduction process 10 described herein may increase the downlink DTX rate in two phases. In the initial phase, the noisy regions originally encoded as speech frames coming in may now be sent out as SID frames. As SID frames are typically encoded with less bits compared to speech frames the overall bandwidth consumed may be reduced. The number of packets coming in and going out may remain the same. In an additional phase, the DTX transmission algorithm may drop some of these newly formed SID frames and thereby reduce the overall bandwidth consumed. In this way, the number of packets going out may be less than the number that came in.

Figure 1:
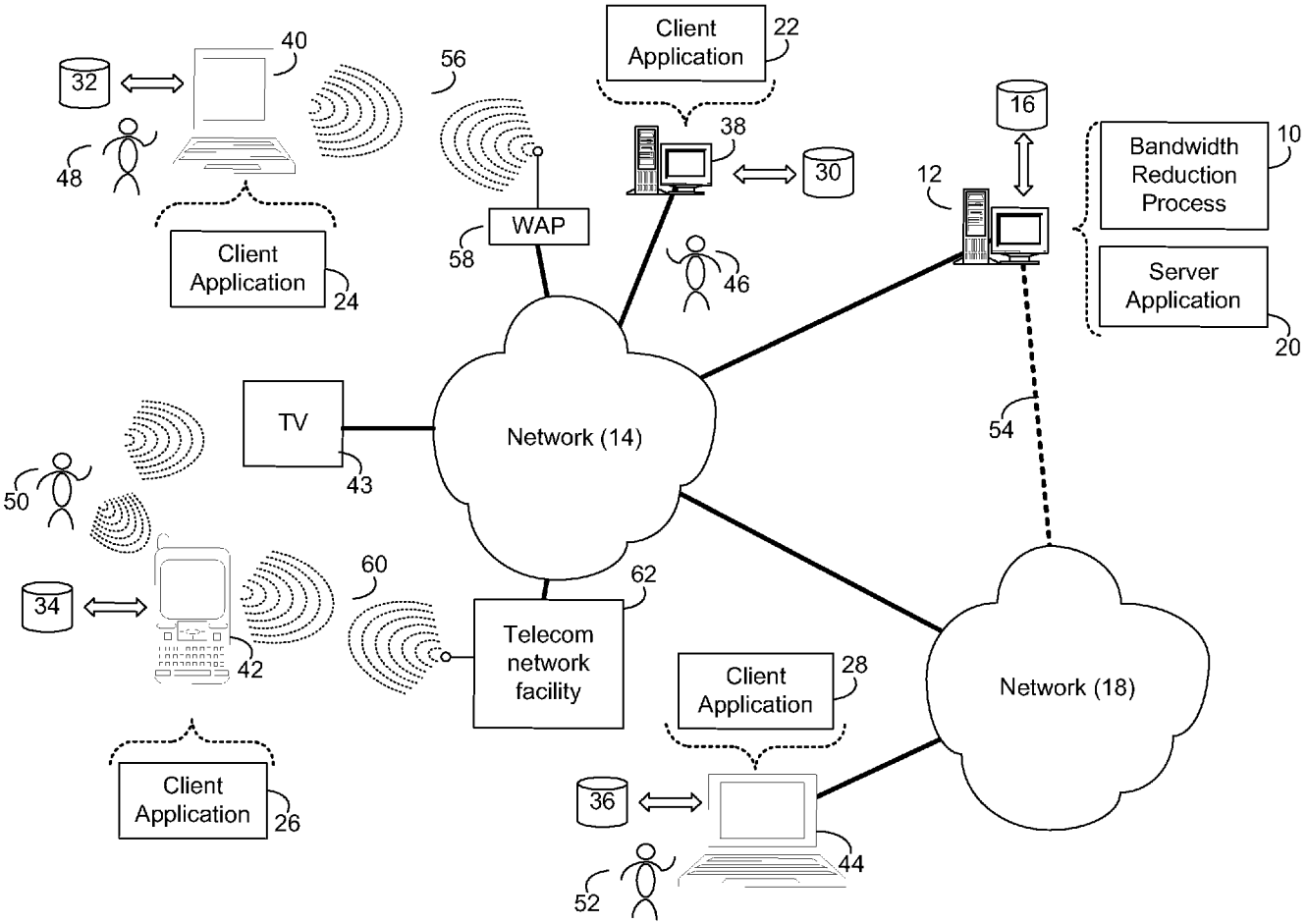
FIG. 1 is a diagrammatic view of an bandwidth reduction process in accordance with an embodiment of the present disclosure.
Figure 2:
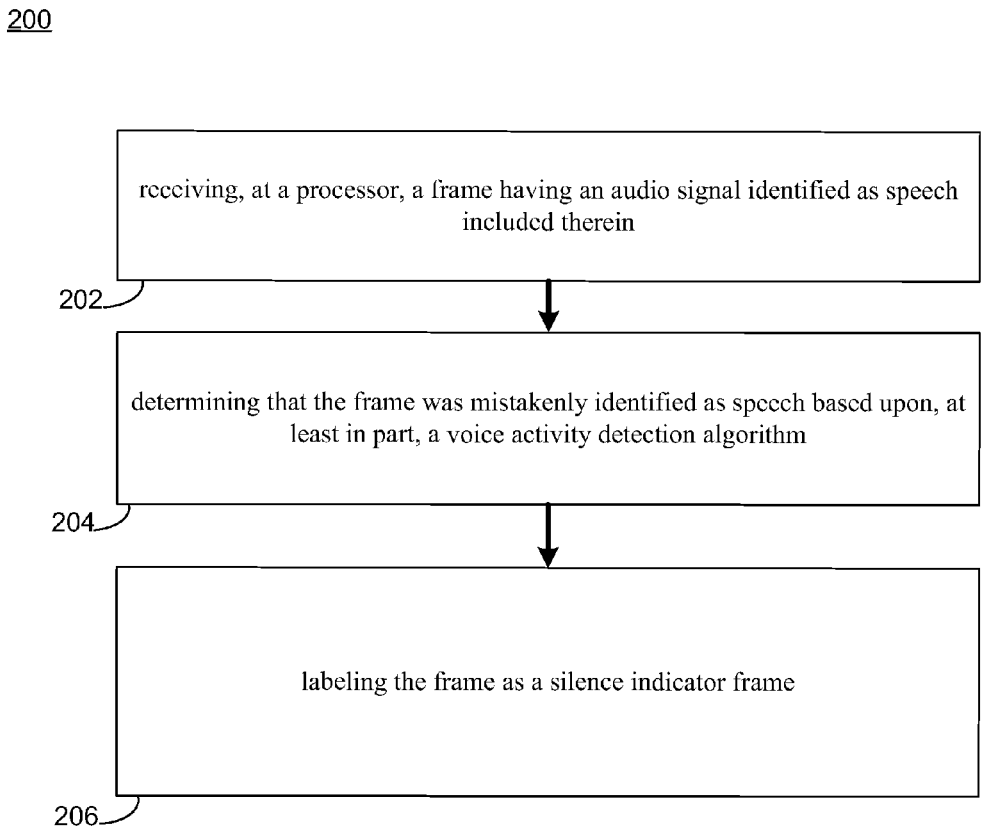
FIG. 2 is a flowchart of a bandwidth reduction process in accordance with an embodiment of the present disclosure.

Referring to FIG. 1, there is shown a bandwidth reduction process 10 that may reside on and may be executed by computer 12, which may be connected to network 14 (e.g., the Internet or a local area network). Server application 20 may include some or all of the elements of bandwidth reduction process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example.

As will be discussed below in greater detail below and in the Figures, bandwidth reduction process 10 may include receiving (202), at a processor, a frame having an audio signal identified as speech included therein and determining (204) that the frame was mistakenly identified as speech based upon, at least in part, a voice activity detection algorithm. The method may further include labeling (206) the frame as a silence indicator frame. Numerous additional features may also be included as discussed in further detail below.

The instruction sets and subroutines of bandwidth reduction process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

In some embodiments, bandwidth reduction process 10 may reside in whole or in part on one or more client devices and, as such, may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), and a dedicated network device (not shown).

One or more of client applications 22, 24, 26, 28 may be configured to effectuate some or all of the functionality of bandwidth reduction process 10. Accordingly, bandwidth reduction process 10 may be a purely server-side application, a purely client-side application, or a hybrid server-side/client-side application that is cooperatively executed by one or more of client applications 22, 24, 26, 28 and bandwidth reduction process 10.

Client electronic devices 38, 40, 42, 44 may each execute an operating system, examples of which may include but are not limited to Apple iOS™, Microsoft Windows™, Android™, Redhat Linux™, or a custom operating system.

Users 46, 48, 50, 52 may access computer 12 and bandwidth reduction process 10 directly through network 14 or through secondary network 18. Further, computer 12 may be connected to network 14 through secondary network 18, as illustrated with phantom link line 54. In some embodiments, users may access bandwidth reduction process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14.

Figure 3:
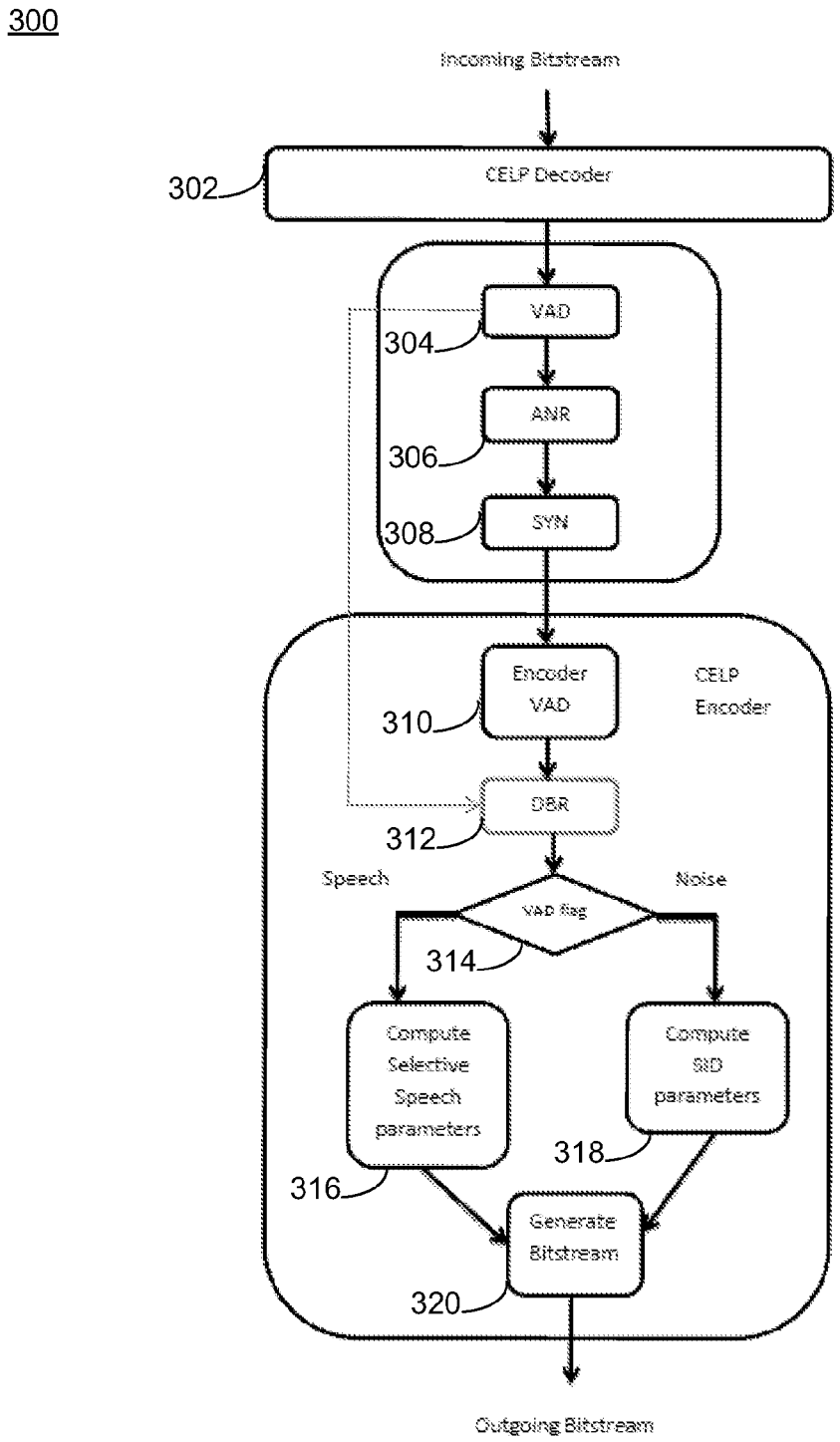
FIG. 3 is a diagrammatic view of a bandwidth reduction process in accordance with an embodiment of the present disclosure.

Referring also to FIG. 3, an embodiment consistent with bandwidth reduction process 10 is provided. In a two party A to B phone call, A's speech may be encoded into the bit stream by the AMR encoder on Phone A. This encoded bit stream may be transmitted through the radio link and through the core network to the radio link on the other side to phone B (e.g., via network 14 shown in FIG. 1). The AMR decoder on phone B may decode the speech and generate comfort noise for the missing SID frames so that B hears A. Additionally and/or alternatively, B's speech may be encoded by the AMR encoder on phone B, which may traverse through the network and may be decoded by the AMR encoder on phone A.

Embodiments of bandwidth reduction process 10 may enable an Ethernet Voice Processor ("EVP") to be placed in the network. For example, on 2G-AoIP (streaming audio over IP), 3G-IuCS links, etc. The EVP may have the ability to decode the incoming packets, perform voice quality enhancement, encode the bit stream and generate outgoing packets.

As is shown in FIG. 3, an embodiment depicting a DTX-Bandwidth-Reduction module ("DBR") within the context of an Ethernet voice processor ("EVP") 300 is provided. The DBR may be configured to receive the VAD decision from the VAD algorithm on the incoming noisy speech and the VAD decision from the AMR VAD algorithm on the noise reduced speech (which may be an output of voice quality assurance ("VQA")). A hangover (e.g., 160 ms) may be applied to the speech decisions made by the VAD algorithm. Improved VAD decision is the AND operation of VAD from this step and AMR VAD decision.

In some embodiments, EVP 300 may include a code-excited linear prediction ("CELP") decoder 302. For example, an AMR codec may be used, however this may be extended to other CELP based speech codecs with DTX. Some of these may include, but are not limited to, GSM-HR, G.729, etc. This decoder may be configured to decompress the encoded bitstream into audio (e.g., in PCM format).

In some embodiments, EVP 300 may further include VAD module 304. Bandwidth reduction process 10 may use one or more voice activity detector ("VAD") algorithms in order to accurately detect both speech and non-speech portions and also to maintain a history of the amount of talking carried out by each talker. Additional information regarding VAD may be found in United States Patent Publication Number 2011/0184732 having an application Ser. No. 13/079,705, which is incorporated herein by reference in its entirety. VAD module 304 may receive raw audio (e.g., in pcm) and may detect which portions are speech and which are not. VAD module 304 may also be configured to convert a time domain signal into frequency domain using any suitable approach (e.g., via fast fourier transform).

In some embodiments, EVP 300 may further include adaptive noise reduction ("ANR") module 306. ANR module 306 may receive a frequency spectrum in and may generate a noise reduced spectrum. The ANR module 306 may be based on spectral subtraction and is discussed in further detail below. EVP 300 may also include synthesis module 308. Synthesis module 308 may be configured to convert the frequency domain signal into time domain signal via inverse fast fourier transform, for example. EVP 300 may further include an encoder VAD module 310. In some embodiments, this module may include a VAD algorithm that comes standard with an AMR encoder. In some cases there are different variants of this algorithm.

As discussed herein, EVP 300 may further include DBR module 312, which may be configured to receive inputs from VAD 304 (e.g., on a noisy speech signal) and VAD 310 (e.g., on a noise reduced speech signal). DBR module 312 may generate a new voice activity decision that leads to converting some of the noise frames originally marked as speech (by the encoder on the handset) to SID frames as is discussed in further detail hereinbelow.

Embodiments of bandwidth reduction process 10 may be used with a Voice Activity Detector (VAD) and may help to improve the performance of an AMR Encoder, after VQA processing. The VAD algorithms built into the standard AMR Encoder may help to reduce the transmission bandwidth during speech pauses by marking those frames as 'SID' frames. This process is referred to as discontinuous transmission (DTX). The DTX Bandwidth Reduction (DBR) module depicted in FIG. 3 may be configured to utilize an improved algorithm for DTX processing on signals that have been processed through the VQA system. A percentage of the frames that were originally marked as speech may be labeled as DTX candidates after the DBR module.

Embodiments of bandwidth reduction process 10 may provide improved channel conditions (e.g., lower interference/improved capacity) and/or improved EVP performance. In some embodiments, bandwidth reduction process 10 may apply a more aggressive VAD algorithm after the VQA processing to mark those frames that the AMR encoder marks as speech but are infarct DTX candidates. Based on these results, there is a possibility of bypassing VQA processing on the EVP module for those frames that the DBR module is likely to mark as SID.

In some embodiments, the AMR codec associated with bandwidth reduction process 10 may include two different VAD modules with varying performance depending on the noise and speech conditions. Accordingly, the first VAD may compute the SNR in one or more bands (e.g., 9) and the VAD decision may be based on one or more thresholds applied to each band and adapted according to the absolute noise level. An SNR dependent holdover time may be added and the starting VAD decision may always be active.

In some embodiments, the second VAD may compute the VAD decision based on various parameters. Some of these may include, but are not limited to, the channel power, voice metrics and noise power parameters. These parameters may be estimated at particular intervals, for example, every 10 ms (e.g., dividing the 20 ms AMR frame into two subframes). The voice metrics may be compared with a threshold that is SNR dependent and a 20 ms frame may be set as active if any subframe is active. An SNR dependent holdover time may be added and the starting VAD decision may always be active.

Embodiments of bandwidth reduction process 10 may utilize one or more algorithms upon receipt of a signal. Some of these may include, but are not limited to, a voice quality assurance, TDM-based VAD algorithm. A number of configurations are possible (e.g., Aggressive, Conservative, VADPP (post processing applied to the VAD decision)). Bandwidth reduction process 10 may also include a low Mips pause detection (LMPD) algorithm. For example, this may refer to an International Telecommunication Union (ITU-T), P.56 based LMPD algorithm, modified to work in an online manner with smaller initial delays (e.g., in the region of 40 ms).

An example of pseudocode associated with an LMPD algorithm is provided below:

```
for actLevLen frame
    Calculate speech activity level [IT93] -> Lev(i)
    AL(i) = (1 - alpha)xLev(i-1) + alpha x Lev(i)
    Enframe to obtain analysis frames
    for each analysis frame
        if abs(s(frame)) > AL(i-1)*Th
            VAD(frame) = 1;
        else
            VAD(frame) =0
        end
    end
end
```

The level in the first actLevLen may be calculated using the RMS energy. Minimum speech duration: bandwidth reduction process 10 may prune away any voice active regions that are less than X ms long. Hold on time: the VAD decision may be held in the active state for a small duration before and after the recognized region (Typical values are XX ms).

Figure 4:
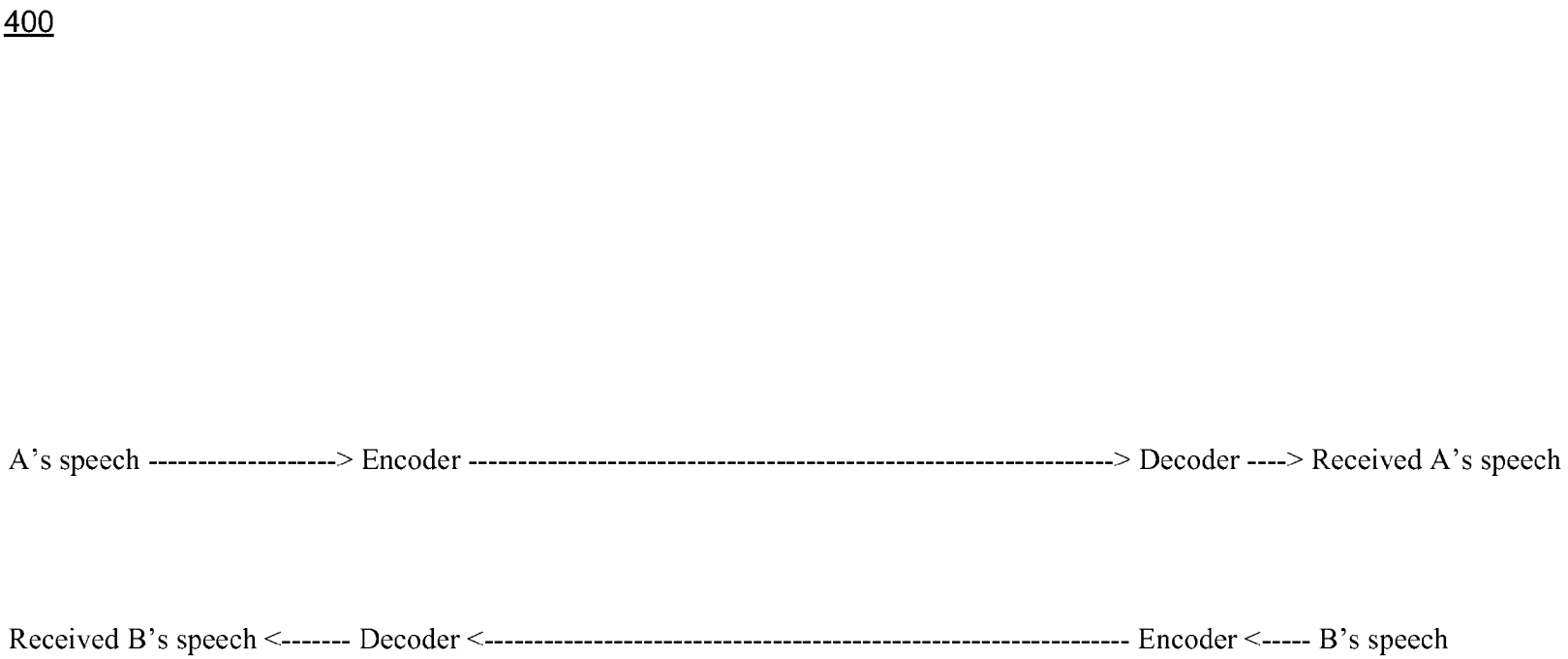
FIG. 4 is a diagrammatic view of a data path of an existing system.

Referring now to FIG. 4, an embodiment depicting an existing data path for a two party phone call between A and B is provided. This embodiment shows the data path through the network without having the benefit of an EVP or bandwidth reduction process 10. In contrast, FIG. 5 shows an embodiment consistent with bandwidth reduction process 10 that includes an EVP on the network and which may be configured to reduce transmission bandwidth with the assistance of DBR module 312.

As discussed above, embodiments of bandwidth reduction process 10 may utilize adaptive noise reduction ("ANR") techniques and one or more voice activity detector algorithms. In speech communication systems the presence of background interference in the form of additive background and channel noise may drastically degrade the performance of the system. Embodiments disclosed herein may incorporate noise reduction algorithms designed to improve the performance of communication systems by reducing noise in a single channel system without introducing audible speech distortion or musical noise. This type of algorithm may employ advanced spectral subtraction techniques based on masking properties of the human auditory system. The algorithm may continuously restore the natural clean speech against a wide variety of noise sources (e.g., car noise, street noise, babble noise, cockpit noise, train noise, harmonic noise, communication channel interference, office noise, wind and etc.). Therefore, it dramatically improves the communication quality—both perceptual quality and signal-to-noise ratio (SNR) measurements.

In some embodiments, ANR operations may include one or more features, some of which may include, but are not limited to, continuously and adaptively removing a wide variety of noise from speech with little speech distortions while preserving background noise characteristics. ANR algorithms may include a configurable maximum noise level suppression up to 21 dB (21 dB, 18 dB, 15 dB, 12 dB, 9 dB). Although the maximum suppression level of background noise is configurable, the actual level of suppression depends on what the local speech and noise characteristics are. For example, if the user configuration is 18 dB maximum attenuation, but at the situation of current local speech and noise characteristic, attenuating 18 dB may cause audible artifacts, an ANR algorithm may automatically reduce the level of attenuation to prevent naturalness of the original speech. In some embodiments, the ANR algorithm may include, for example, 15 ms algorithm latency, convergence time of less than 2 s, approximately 3.87 MCPS processing complexity using TI TMS320CC54x processor when zero-padding flag is turned on, and approximately 4.43 MCPS processing complexity using TI TMS320CC54x processor when zero-padding flag is turned off. Some embodiments may utilize an ANR algorithm having a comfort noise floor option with configurable noise floor level. Additionally and/or alternatively, an SNR adaptive mode may automatically enable maximum noise reduction for low-SNR inputs (i.e. SNR<12 dB), while applying moderate or minor reduction to the higher SNR inputs. This may reduce the noise aggressively when noise is really high, however in less noisy conditions, the level of noise reduction may adapt according to the signal SNR to minimize the undesirable impact on the speech signal due to noise reduction processing.

In some embodiments, and to further improve the accuracy of VAD decision and convergence time for the adaptive noise reduction, four major improvements are made to the VAD module. In some embodiments, a high-pass filter may be included, which may include (1) the reduction of number of critical band from 18 bands to 17 bands, and (2) some adjustments on boundary mapping of critical bands. In some embodiments, adding a high-pass filter before VAD processing may aid the decision for some noise type (esp. wind noise). At the same time, other modules in the system (i.e. tone detection) may need HPF. HPF may be added before VAD in some cases. Due to the limited-number of frequency bins, some bins may be mapped into different bands.

Additionally and/or alternatively, some embodiments of the VAD may be designed to give bias to active decision since it may be designed as part of adaptive noise reduction (ANR) module. When the decision is used for other purposes (e.g. ALC) the fast recognition of non-active speech becomes more and more important since this may affect ALC's convergence time though it may not affect ANR's performance. For example, when the input is clean on-off high-level tones with very short (e.g., 50 ms) silence gaps, the original VAD may not be able to recognize these silence gaps consistently. To overcome this, the improvement made here is to introduce a short-term energy Es (n) (time constant is about 11 ms).

$$E_s^i(n) = \beta E_s^i(n-1) + (1-\beta)E_n^i(n),$$

$$\beta = 0.1$$

$$E_{sdB}^i(n) = 10\log_{10}E_s^i(n)\ dB$$

$$\nabla E_{sdB}(n) = \sum_{each\ critical\ band\ i} \left(E_{sdB}^i(n) - \overline{E}^i(n)\right)$$

Where i is the index of critical band, n is the index of frame number. When $\nabla E_{sdB}$ (n) is below a threshold and the voicing parameter for current frame is low, the current frame is preliminary decided as a non-active frame. Of course, this preliminary decision will be smoothed by VAD hangover later.

Embodiments disclosed herein may improve the VAD initial convergence when idle code detection is not available. For example, the original VAD assumes the initial 100 ms of input signal are non-active and VAD states are kept in non-active state. These 100 ms signals are used to build up the initial VAD state variables, which will affect the initial convergence rate. This design can aggressively achieve very fast initial convergence. Embodiments disclosed herein may include both aggressive operating mode and normal operating mode for VAD. The aggressive operating mode is the same as the original VAD design, when idle code detection is enabled at "either", the VAD can be set to this mode to maintain the faster convergence. While idle code detection is not available or provisioned as other options, the VAD should be set as normal operating mode, in which for the first 40 ms, the VAD state variables is built up exponentially:

$$Eavg^i(n) = \frac{15}{16}Eavg^i(n-1) + \frac{1}{16}E^i(n)$$

$$Eavg^i(0) = 0,$$

$$i = 0, 1, \ldots, 16$$

Note n is the frame index, and i is the critical band index.

Embodiments disclosed herein may improve the general VAD convergence time for various conditions. The following efforts are made to improve the VAD performance, and consequently to improve the ANR convergence time: Noise floor power spectral tracking for each critical band and improved computation of average energy for each critical band.

Noise floor power spectral $P^i(n)$ for i-th critical band at frame n is tracked even during speech frames. During the speech frame, $$\text{if } P^i(n-1)<E^i(n)$$

$$P^i(n)=c^i(n-1)+\beta E^i(n)+(n-1),\ \alpha=0.998,\ \beta=0.05,\ \gamma=-0.048$$

else $$P^i(n)=E^i(n)$$

Where $E^i(n)$ is the input signal power at the i-th critical band at n-th frame.

The time-constant for updating average signal energy in dB is power-adapted. For the i-th critical band, and for n-th frame:

$$E^i(n)=E^i(n-1)+(1-\alpha)E^i(n) \text{ in dB}$$

Where $$\alpha=\alpha_H-\beta(E_H-E_{total}),\ \alpha_H=0.97$$

Embodiments disclosed herein may improve VAD convergence after network dropouts. As observed from filed captures, GSM switches insert mute pattern when multiple frames are dropped. The long dropouts will reset VAD noise estimation and result in VAD re-convergence after network recovery. When the noise level after dropouts is large, it will take quite a long time for VAD to re-recognize the noise frames. The customer may complain the noise coming back after dropouts. To fasten the re-convergence time, changes are made in VAD to freeze updating noise spectral contour when such dropouts are detected. This on one hand will speed up the re-convergence (need no time to converge when noise unchanged before and after dropouts), on the other hand, this change will not affect initial convergence time since an initial noise spectral is assumed.

In some embodiments, the ideal noise reduction algorithm will only remove noise part from the noisy speech while maintain speech part untouched. However, in reality this is usually not possible to find such an ideal algorithm. Therefore the realistic requirement for noise reduction algorithms becomes removing noise as much as possible while maintain the speech distortions as low as possible. Spectral shaping is designed to work together with ANR algorithm to reduce the perceptual speech distortion introduced by ANR. The goal of spectral shaping is to reduce perceptible speech artifacts introduced by ANR/NS while maintaining ANR/NS's ability to reduce noise. The idea is to boost perceptual important spectral areas of the processed speech, i.e. formants, to maintain the noise reduction the same, the spectral areas with less perceptual importance are suppressed further. Both objective and subjective tests show that spectral shaping improves quality of ANR/NS processed speech, especially for the tandem situation.

In some embodiments, adding a comfort noise floor option may help to avoid quite-line problem found in the field when noise reduction attenuates noise to a level that is too low, people may have dead-line perception. When the comfort noise floor option is turned on in the configuration, a comfort noise floor will be presented in the processed output. The noise floor level is configurable, the default value is about −55 dBov. The option is by default always on when noise silencer is turned on. For the ANR feature, this option can be switched through user configuration. This option is recommended to be turned off when conducting any objective testing on ANR. But it is recommended to be turned on when involving subjective listening.

In some embodiments, adding a frame loss handling feature inside VAD through user-configurable interface of ANC may improve VAD re-convergence time when frame loss happened during speech. The design goals are to maintain fast re-convergence when frame loss happens, especially in the middle of noisy speech and to reduce mis-detection of frame loss which may cause level attenuation for small signal. In order to achieve the above targets, the following scheme is designed to handle possible frame loss: Short term frame energy E is computed, if E is very low and consistent for some period, possible frame loss may happen, within the first 300 ms continuous possible-loss frames, the current frame will not contribute to the noise spectral updates at all, if this period exceeds 300 ms, only a portion of current frame will contribute to the noise spectral updates, the percentage of contribution will be increased as time passes. When the possible-loss frames continue more than 1 s, the current frame will be fully contributed to the noise spectral updates, just like there is no frame loss handling. The assumption behind this scheme is that most quality-reasonable frame loss happens within 1 s. This feature can be configurable to disable, standard frame loss handling, and high frame loss handling through ANC interface. The recommended setting is standard. However, if most environments of customers' network are with high noise, while customers still want to utilize ANC to increase channel capacity by turning on network DTX, high frame loss handling is recommended.

In some embodiments, an SNR-adaptive ANC operation may be employed to balance the amount of noise reduced and the undesired impact on the speech signal due to the processing. The design goals of adding the adaptive mode to existing ANC, may include improving tandem ANC subjective performance, i.e. the cleaner the input is, the less aggressive attenuation is, and the less artifacts is introduced too. For example, if the original input SNR is high enough, the tandem output will be very similar to the first ANC output. This will also improve clean speech subjective qualities. The overall SNR-adaptive ANC design is based on the following SNR-Gain function:

$$\text{Gain} = \begin{cases} -18 \text{ dB} & \text{when } SNR \le (\max SNR - 18)\text{dB} \\ (SNR - \max SNR) \text{ dB} & \text{when } (\max SNR - 18)\text{dB} < SNR \le \max SNR \\ 0 \text{ dB} & \text{when } SNR > \max SNR \end{cases}$$

Figure 6:
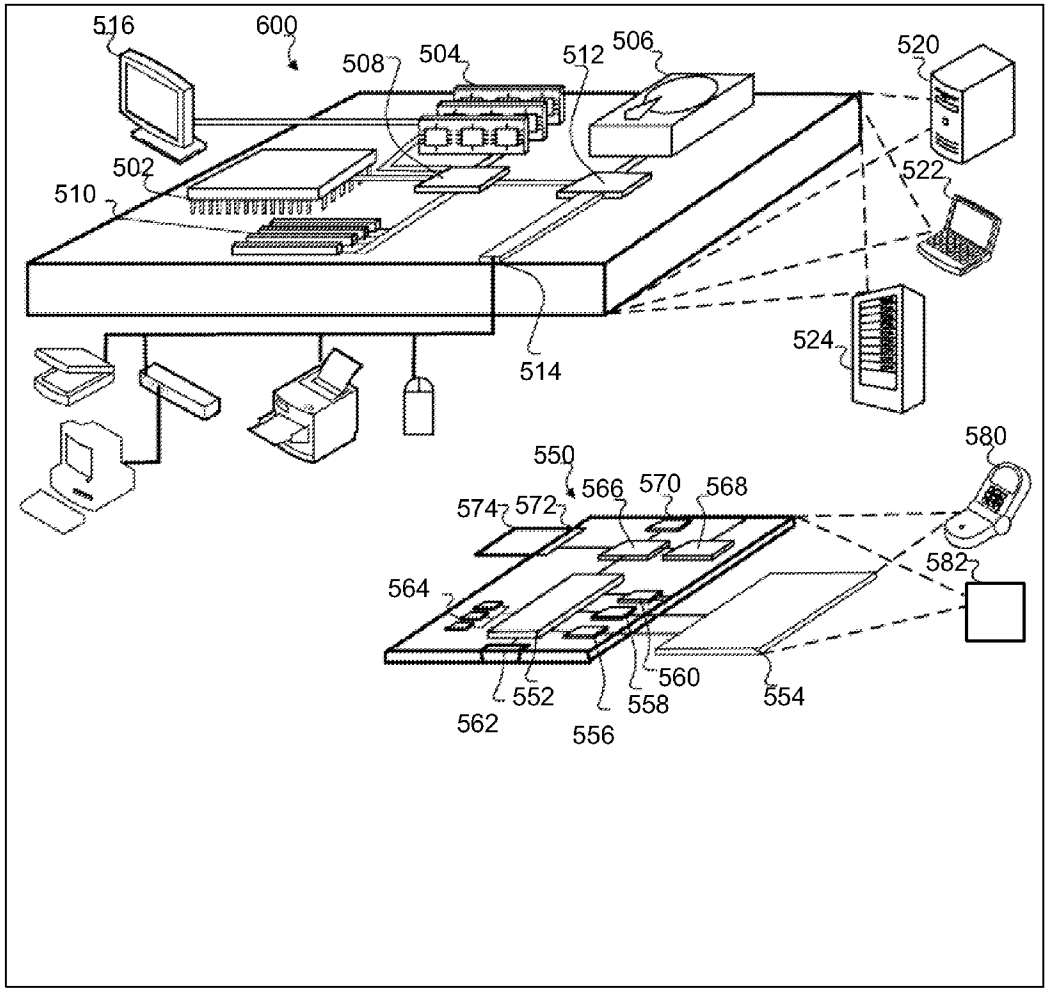
FIG. 6 shows an example of a computer device and a mobile computer device that can be used to implement embodiments of the present disclosure.

Referring now to FIG. 6, an example of a generic computer device 600 and a generic mobile computer device 550, which may be used with the techniques described herein is provided. Computing device 600 is intended to represent various forms of digital computers, such as tablet computers, laptops, desktops, workstations, personal digital assistants, servers, blade servers, mainframes, and other appropriate computers. In some embodiments, computing device 550 can include various forms of mobile devices, such as personal digital assistants, cellular telephones, smartphones, and other similar computing devices. Computing device 550 and/or computing device 600 may also include other devices, such as televisions with one or more processors embedded therein or attached thereto. The components shown here, their connections and relationships, and their functions, are meant to be exemplary only, and are not meant to limit implementations of the inventions described and/or claimed in this document.

In some embodiments, computing device 600 may include processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, may be interconnected using various busses, and may be mounted on a common motherboard or in other manners as appropriate. The processor 502 can process instructions for execution within the computing device 600, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

Memory 504 may store information within the computing device 600. In one implementation, the memory 504 may be a volatile memory unit or units. In another implementation, the memory 504 may be a non-volatile memory unit or units. The memory 504 may also be another form of computer-readable medium, such as a magnetic or optical disk.

Storage device 506 may be capable of providing mass storage for the computing device 600. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, memory on processor 502, or a propagated signal.

High speed controller 508 may manage bandwidth-intensive operations for the computing device 600, while the low speed controller 512 may manage lower bandwidth-intensive operations. Such allocation of functions is exemplary only. In one implementation, the high-speed controller 508 may be coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 600 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 600 may be combined with other components in a mobile device (not shown), such as device 550. Each of such devices may contain one or more of computing device 600, 550, and an entire system may be made up of multiple computing devices 600, 550 communicating with each other.

Computing device 550 may include a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, may be interconnected using various buses, and several of the components may be mounted on a common motherboard or in other manners as appropriate.

Processor 552 may execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

In some embodiments, processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

In some embodiments, memory 564 may store information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 564, expansion memory 574, memory on processor 552, or a propagated signal that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

Computing device 550 may be implemented in a number of different forms, as shown in the figure. For example, it may be implemented as a cellular telephone 580. It may also be implemented as part of a smartphone 582, personal digital assistant, remote control, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A method for discontinuous transmission ("DTX") bandwidth reduction comprising:

receiving, at a processor, a frame having an audio signal identified as speech included therein;

determining that the frame was mistakenly identified as speech based upon, at least in part, a voice activity detection algorithm;

in response to determining that the frame was mistakenly identified as speech, labeling the frame as a silence indicator frame; and bypassing an intended voice quality assurance processing operation based upon, at least in part, the determination.

2. The method of claim 1, further comprising:

computing a signal to noise ratio associated with the frame.

3. The method of claim 2, further comprising:

adding a signal to noise ratio dependent holdover time prior to transmission.

4. The method of claim 1, further comprising:

computing a voice activity detection decision based upon, at least one of, channel power, voice metrics, and noise power parameters.

5. The method of claim 4, wherein computing occurs every 10 ms.

6. The method of claim 4, wherein computing is based upon voice metrics, the voice metrics compared with a signal to noise ratio dependent threshold.

7. The method of claim 6, wherein a starting VAD decision is always active.

8. A system for discontinuous transmission ("DTX") bandwidth reduction comprising:

a computing device configured to receive, at one or more processors, a frame having an audio signal identified as speech included therein, the one or more processors further configured to determine that the frame was mistakenly identified as speech based upon, at least in part, a voice activity detection algorithm, the one or more processors further configured to label the frame as a silence indicator frame, in response to determining that the frame was mistakenly identified as speech, the one or more processors further configured to compute a signal to noise ratio associated with the frame, the one or more processors further configured to add a signal to noise ratio dependent holdover time prior to transmission.

9. The system of claim 8, the one or more processors further configured to bypass an intended voice quality assurance processing operation based upon, at least in part, the determination.

10. The system of claim 8, the one or more processors further configured to compute a voice activity detection decision based upon, at least one of, channel power, voice metrics, and noise power parameters.

11. The system of claim 10, wherein computing occurs every 10 ms.

12. The system of claim 10, wherein computing is based upon voice metrics, the voice metrics compared with a signal to noise ratio dependent threshold.

13. The system of claim 12, wherein a starting VAD decision is always active.

14. A method for discontinuous transmission ("DTX") bandwidth reduction comprising:

receiving, at a processor, a frame having an audio signal identified as speech included therein, the frame identified by an adaptive multi-rate ("AMR") encoder associated with a voice quality assurance module;

determining that the frame was mistakenly identified as speech by the AMR encoder based upon, at least in part, a voice activity detection algorithm;

in response to determining that the frame was mistakenly identified as speech, labeling the frame as a silence indicator frame; and bypassing an intended voice quality assurance processing operation based upon, at least in part, the determination.

15. The method of claim 14, further comprising:

computing a signal to noise ratio associated with the frame.

16. The method of claim 15, further comprising:

adding a signal to noise ratio dependent holdover time prior to transmission.

17. The method of claim 14, further comprising:

computing a voice activity detection decision based upon, at least one of, channel power, voice metrics, and noise power parameters.

* * * * *